US006231215B1

(12) United States Patent
Spitler et al.

(10) Patent No.: US 6,231,215 B1
(45) Date of Patent: May 15, 2001

(54) HALOGEN TASKLIGHT

(75) Inventors: Brian L. Spitler, Elon College, NC (US); Pei Sheng Qian, Shanghai (CN)

(73) Assignee: Regent Lighting Corporation, Burlington, NC (US)

( * ) Notice: Subject to any disclaimer, the term of this patent is extended or adjusted under 35 U.S.C. 154(b) by 0 days.

(21) Appl. No.: 09/333,731

(22) Filed: Jun. 15, 1999

(51) Int. Cl.[7] ..... F21V 21/29

(52) U.S. Cl. ..... 362/421; 362/410; 362/421; 362/250; 362/396

(58) Field of Search ..... 362/287, 427, 362/432, 147, 365, 370, 371, 404, 421, 238, 239, 250, 249

(56) References Cited

U.S. PATENT DOCUMENTS 5,335,159 * 8/1994 Chen et al. ..... 362/421
5,493,484 * 2/1996 Osteen et al. ..... 362/410
5,510,970 * 4/1996 Hollenbach et al. ..... 362/396
5,833,359 * 11/1998 Hollenbach ..... 362/250

* cited by examiner

*Primary Examiner*—Sandra O'Shea
*Assistant Examiner*—David V. Hobden
(74) *Attorney, Agent, or Firm*—Niro, Scavone, Haller & Niro

(57) ABSTRACT

A halogen shop light having an elongated housing defining an interior space and mountable to a support surface and which includes an external receptacle. The light also includes a light source comprised of a housing, handle, lens, halogen lamp, and outwardly extending post which terminates in a ball like free end. A second post extending from the housing is also provided. The second post has inner and outer sleeves which are rotatably connected. There is also a socket in the second post which receives the ball-like free end to form an universally rotatable ball and socket connection. Wiring for energizing the lamp and the external receptacle is further provided and the wiring is placed in a channel which travels through the posts and ball.

1 Claim, 1 Drawing Sheet

HALOGEN TASKLIGHT

BACKGROUND OF THE INVENTION

The present invention relates to portable worklights. More specifically, the present invention relates to a portable halogen worklight that is positionable in a plurality of positions and which may be connected in series to form multiple light configurations.

SUMMARY OF THE INVENTION

The present invention is comprised of an elongated base housing in which internal wiring is located. An external receptacle and power cord is also in communication with the wiring. A halogen lamp is mounted to the housing by a rotatable post and universally rotatable ball and socket connection. Placing an external receptacle on the housing allows for another light unit to be connected to the unit. This permits multiple lights to be strung together allowing for customized lighting configurations.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
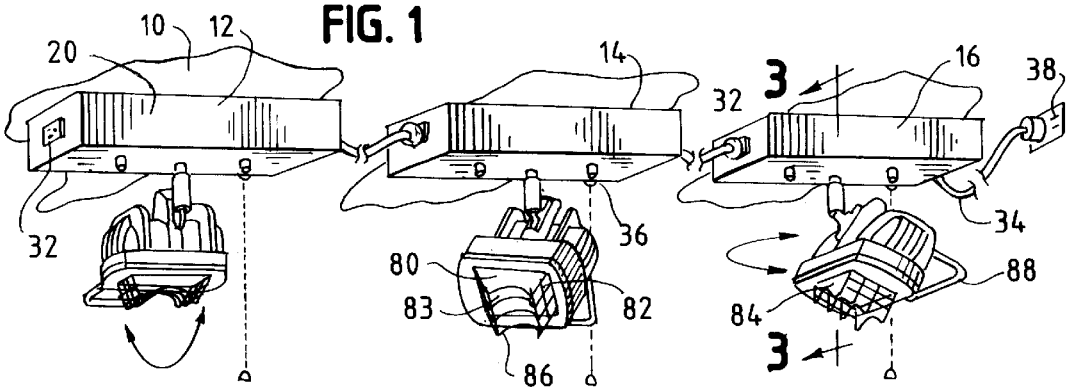
FIG. 1 is a perspective view of a multiple light system of the present invention.
Figure 2:
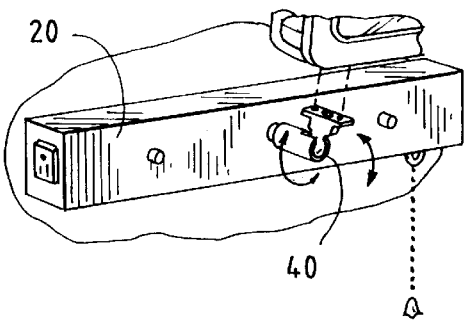
FIG. 2 is an exploded perspective view of the mounting post.
Figure 3:
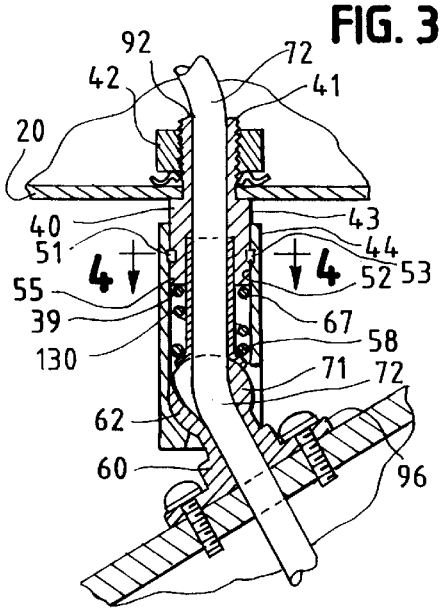
FIG. 3 is a cross-sectional view of the mounting post.
Figure 4:
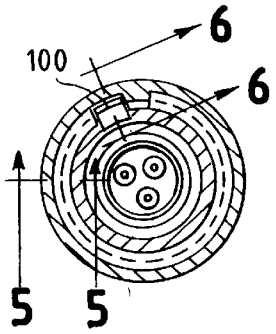
FIG. 4 is a sectional view taken along line 4—4.
Figure 5:
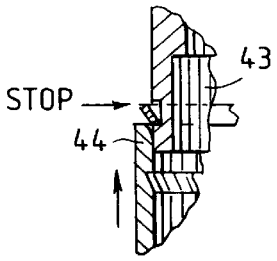
FIG. 5 is a sectional view taken along line 5—5.
Figure 6:
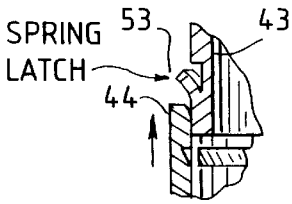
FIG. 6 is a sectional view taken along line 6—6.

As shown in FIGS. 1–3, the present invention concerns a light system 10 comprised of a number of individual lights 12, 14, and 16. The design of each light is the same. As is shown, an elongated rectangular housing or base 20 is provided in which internal wiring is located. The wiring is in communication with light switch 30, external receptacle 32, and power cord 34, which connects to a receptacle 38 to energize the light. The housing is mountable to support surface via fasteners and/or adhesives and the like. Housing 20 may be a single piece of formed metal or a multiple piece design.

Extending outwardly from housing 20 is mounting post 40. Post 40 has a threaded end portion 41 which extends through housing 20 and is secured to housing 20 by coacting fastener 42. As shown in FIGS. 3–6, post 40 is comprised of two coaxially aligned sleeves 43 and 44 which are rotatably affixed together. Inner sleeve 43 is cylindrical in shape and terminates in planar free end 59. It has two grooves 51 and 52 in which a spring latch 53 and roller bearing stop 55 are located. Outer sleeve has a groove 61 and another groove 67 in which inwardly projecting stop 63 is located. When sleeve 43 is inserted into sleeve 44, spring latch 53 is compressed until it engages groove 61 which then allows spring 53 to expand into the groove. This then locks sleeve 43 into sleeve 44 by preventing axial movement yet permitting rotational movement. The coaction between stops 55 and 63 in groove 67 prevent the complete rotation of the sleeves. This prevents the internal wiring from being twisted. Roller bearings 130 promote the smooth rotation of the sleeves.

A post 60 with ball 62 on the free end extends from light housing 66 and is secured within coacting socket 58 on post 40. Mounting ball 62 in socket 58 creates a universally positionable ball and socket design. A spring 70 located between free end 59 and ball 62 which urges ball 62 against socket 58. Post 40, post 60, and ball 62 all have an aperture or channel 71 which permits the passage of wiring 72. Passing the wiring 72 through the channel created permits the wiring to be substantially covered during use.

Light housing 66 defines an interior space 80 in which bulb 82 is located. A lens 84 and reflector 83 are also provided as is a wire-grill 86. A handle 88 may also be used to position the light.

In use, multiple lights may be connected together in a series as is shown in FIG. 1. Providing an external receptacle 32 allows a power cord from one light to be connected to another previously connected light. Configuring the devices in this manner permits a wider variety of lighting configurations.

Figure 7:
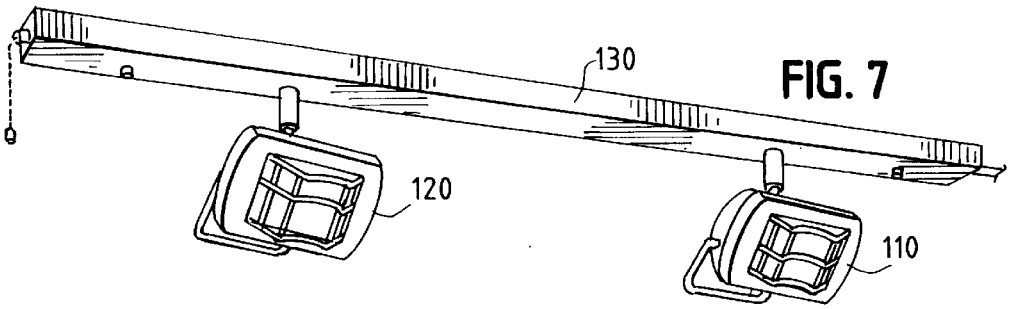
FIG. 7 is a perspective view of an alternate embodiment of the present invention.

The rotatable post and ball and socket combination permit nearly universal positioning of the light fixtures. When combined with the dual lamp configuration shown in FIG. 7, lights 110 and 120 on housing 130 may provide a wide range of illumination.

It should be understood that various changes and modifications to the preferred embodiments described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A halogen shop light mountable to a support surface, comprising:

an elongated housing having an external receptacle and defining an interior space and mountable to a support surface;

a lamp housing having a lens, halogen lamp, and outwardly extending post which terminates in a ball like free end;

a second post extending from said elongated housing, said second post comprising inner and outer sleeves, said sleeves rotatably connected;

a socket in said second post for receiving said ball-like free end to form an universally rotatable ball and socket connection; and wiring for energizing said lamp and said external receptacle with said wiring connected to said lamp through a channel in said posts and ball.

* * * * *